US011541623B2

(12) United States Patent
Wieduwilt

(10) Patent No.: US 11,541,623 B2
(45) Date of Patent: Jan. 3, 2023

(54) METHOD AND APPARATUS FOR JOINING PAPER MATERIAL

(71) Applicant: Syntegon Technology GmbH, Waiblingen (DE)

(72) Inventor: Ulrich Wieduwilt, Schwaebisch Gmuend (DE)

(73) Assignee: Syntegon Technology GmbH, Waiblingen (DE)

( * ) Notice: Subject to any disclaimer, the term of this patent is extended or adjusted under 35 U.S.C. 154(b) by 0 days.

(21) Appl. No.: 17/433,651

(22) PCT Filed: Feb. 19, 2020

(86) PCT No.: PCT/EP2020/054278
§ 371 (c)(1),
(2) Date: Aug. 25, 2021

(87) PCT Pub. No.: WO2020/178024
PCT Pub. Date: Sep. 10, 2020

(65) Prior Publication Data

US 2022/0048271 A1 Feb. 17, 2022

(30) Foreign Application Priority Data

Mar. 1, 2019 (DE) ..... 10 2019 202 850.0

(51) Int. Cl.
*B31F 5/00* (2006.01)

(52) U.S. Cl.
CPC ..... *B31F 5/008* (2013.01)

(58) Field of Classification Search
CPC ..... B31F 5/00; B31F 5/008; B31B 1/72
(Continued)

(56) References Cited

U.S. PATENT DOCUMENTS 6,942,608 B2 9/2005 Linton et al.
2003/0131919 A1 7/2003 King et al.
(Continued)

FOREIGN PATENT DOCUMENTS

CN 1575210 A 2/2005
CN 1589200 A 3/2005
(Continued)

OTHER PUBLICATIONS

International Preliminary Reporton Patentability for Application No. PCT/EP2020/054278 dated Aug. 25, 2021 (8 pages).
(Continued)

*Primary Examiner* — Chelsea E Stinson
(74) *Attorney, Agent, or Firm* — Michael Best & Friedrich LLP

(57) ABSTRACT

The present invention relates to a method for joining paper material (2, 3) in a first joining region (20) and a second joining region (30), comprising the steps of: roughening the first joining region (20) and/or the second joining region (30), moistening the first joining region (20) and/or the second joining region (30), and joining the first and second joining region (20, 30) between a sonotrode (60) and an anvil (63) of an ultrasonic friction welding apparatus (6) by means of ultrasonic friction welding, wherein a vibration direction (A) of the sonotrode (60) is not parallel to a joining force direction (B) of a joining force of the anvil (63).

17 Claims, 9 Drawing Sheets

(58) Field of Classification Search
USPC ..... 493/326, 340, 344, 353, 354
See application file for complete search history.

(56) References Cited

U.S. PATENT DOCUMENTS

| | | | | |
|---|---|---|---|---|
| 2009/0298662 | A1* | 12/2009 | Maatta | B31F 5/008 493/383 |
| 2011/0152051 | A1 | 6/2011 | Murray | |
| 2016/0311189 | A1* | 10/2016 | Wieduwilt | B65B 5/024 |
| 2018/0153211 | A1* | 6/2018 | Persson | B29C 66/71 |
| 2020/0070462 | A1* | 3/2020 | Tuszkiewicz | B29C 65/08 |
| 2021/0403185 | A1 | 12/2021 | Ferris et al. | |

FOREIGN PATENT DOCUMENTS

| | | | |
|---|---|---|---|
| CN | 102792052 | A | 11/2012 |
| CN | 104755258 | A | 7/2015 |
| CN | 106466921 | A | 3/2017 |
| DE | 1156303 | B | 10/1963 |
| DE | 1294175 | B | 9/1969 |
| DE | 102009053415 | A1 | 5/2011 |
| DE | 102013225737 | A1 | 6/2015 |
| DE | 102013225743 | A1 | 6/2015 |
| DE | 102013225745 | A1 | 6/2015 |
| EP | 0340334 | A2 | 11/1989 |
| EP | 0390733 | A2 | 10/1990 |
| JP | 2006283232 | A | 10/2006 |
| JP | 2007126249 | A | 5/2007 |
| JP | 2007126249 | A * | 5/2007 |
| TW | I301469 | B | 10/2008 |
| WO | 9925547 | A1 | 5/1999 |

OTHER PUBLICATIONS

Translation of International Search Report for Application No. PCT/EP2020/054278 dated May 27, 2020 (2 pages).
Chinese Patent Office First Office Action for Application No. 202080017870.3 dated Dec. 22, 2021 (9 pages including English translation).
United States Patent Office Non-Final Office Action for U.S. Appl. No. 17/433,632 dated Feb. 16, 2022 (16 pages).
United States Patent Office Final Office Action for U.S. Appl. No. 17/433,632 dated Apr. 27, 2022 (18 pages).
Translation of Japanese Patent Office Communication of Reasons for Rejection for Application No. 2021-551856 dated Mar. 31, 2022 (13 pages).
Translation of International Search Report for Application No. PCT/EP2020/054961 dated Jun. 2, 2020 (2 pages).
International Written Opinion for Application No. PCT/EP2020/054961 dated Jun. 2, 2020 (English translation included, 10 pages).

* cited by examiner

METHOD AND APPARATUS FOR JOINING PAPER MATERIAL

BACKGROUND

The present invention relates to a method and an apparatus for joining paper material, in particular paper, cardboard or paperboard or the like, wherein the joining process may be carried out without additional auxiliary materials, in particular in a manner that is free of plastics materials and/or adhesive.

EP 0 340 334 A2 discloses an apparatus which joins paper products by means of ultrasonic. The paper used in said document has a thermoplastic coating. This thermoplastic coating is melted on during the joining process. After cooling and curing, the joining regions of the paper layers are then interconnected. Furthermore, DE 10 2013 225 745 A1 discloses an ultrasonic joining method for connecting paper material, in which method ultrasonic friction welding is carried out. These known methods have proven themselves in principle, but there is an urgent need, in particular due to stricter environmental regulations, for packaging, for example, to be made entirely of paper material that is recyclable and contains no other additional ingredients, in particular plastics materials or adhesives or the like, which can result in environmental pollution.

SUMMARY

By way of contrast, the method according to the invention for joining paper materials has the advantage that untreated paper material can be used to produce packaging, for example. This is achieved according to the invention in that the method for joining paper material, which has a first and a second joining region, comprises the following steps: roughening the first and/or second joining region, moistening the first and/or second joining region and joining the first and second joining region between a sonotrode and an anvil of an ultrasonic unit by means of ultrasonic friction welding, wherein a vibration direction of the sonotrode is not parallel to a joining force direction of a joining force. The first and second joining region can be provided on a single paper material, or one joining region is provided on a separate paper material. Roughening the joining region ensures that a three-dimensional increase of the joining region is achieved at the joining surface. The additional provision of water on the joining surface allows a hydrogen bridge bond to be formed during the joining process. The joining process is carried out using pressure and ultrasonic action.

The clever concept of roughening the paper surface increases the strength of the connection produced. During the roughening process, individual paper fibers are released from the paper composite and brought to the surface of the joining region. This increases the roughness of the joining surface.

The method according to the invention can be carried out in various ways.

In a first step, the joining region of the paper material is preferably roughened and then the roughened joining region is moistened with water or another liquid. The second joining region remains untreated. The joining process can then be carried out.

Alternatively, the first joining region is roughened and the second joining region is moistened. The roughened joining region and the second moistened joining region are then joined together.

According to a further alternative, the first joining region of the paper material is moistened and then the moistened first joining region is roughened. The second joining region can remain untreated or alternatively be roughened or alternatively only moistened or further alternatively both roughened and moistened.

Due to the heat introduced during the ultrasonic friction welding, the water applied by the moistening evaporates and a stable connection between the two paper materials can be achieved.

The invention is particularly preferably carried out on only the first joining region, wherein further preferably first roughening and then moistening being carried out. The second joining region can thus be left untreated and a joining process can then be carried out.

By carrying out the roughening process before the joining step, a significantly improved connection between the two joining regions of the paper materials is thus achieved. The step of roughening is preferably carried out by machine so that the joining region is always uniformly roughened.

The dependent claims show preferred further developments of the invention.

Preferably, a particularly good ultrasonic friction welding process is ensured if a vibration direction of the sonotrode is perpendicular or substantially perpendicular to the joining force direction. This ensures high energy input into the joining region, and therefore the joining time can be significantly shortened.

The method is preferably carried out continuously. In this way, for example, a closed seam, which is used in particular in packaging or the like, can be produced. Continuous execution of the method also ensures a linear joining connection in the joining regions. Alternatively, the method is carried out discontinuously if, for example, no closed joining connection is to be produced.

Particularly good joining results are obtained if the roughening of the first joining region and/or the second joining region is carried out in such a way that a roughness in a range of ±20 μm, in particular ±10 μm, around a central plane of the paper material is achieved. As a result, substantially consistent roughening of the surface of the joining region can be achieved, which leads to excellent joining results.

Further preferably, a width of the roughened joining region is equal to a width of the moistened joining region. The joining process is further preferably carried out entirely without additives, in particular thermoplastic plastics materials or adhesives or the like. In particular, the paper materials to be joined are free of plastics material and adhesive. Furthermore, the paper materials do not have any plastics material coating or the like.

A particularly compact apparatus for carrying out the method is achieved if the step of roughening is also carried out by means of ultrasonic. In this case, two ultrasonic units can then be arranged one after the other, the first ultrasonic unit for roughening at least one joining region and then the second ultrasonic unit for carrying out the joining step.

The roughening process is preferably carried out continuously or alternatively discontinuously. If the roughening process is to be carried out by means of ultrasonic, a sonotrode of an ultrasonic unit is preferably designed such that the sonotrode has a flat sonotrode surface directed toward the paper material. As a result, excellent roughening can be obtained in a predetermined range.

The present invention also relates to an apparatus for joining paper materials, comprising a roughening apparatus for roughening at least one joining region of a paper material, a moistening apparatus for moistening at least one joining region of the paper material and an ultrasonic friction welding apparatus comprising a sonotrode for generating an ultrasonic vibration and an anvil for generating a joining force, wherein the joining force being directed in a non-parallel direction that is different from a direction of the ultrasonic vibrations of the sonotrode.

Thus, the ultrasonic friction welding apparatus ensures that a vibration direction of the sonotrode and a joining force direction of the joining force are not parallel, and thus increased heat input is achieved by the ultrasonic friction welding process.

The anvil is preferably a roller or roll. In this way, it is easily possible for the joining force or the roughening force to have a different direction to the direction of vibration.

The roughening apparatus is further preferably an ultrasonic generator. A separate ultrasonic generator is preferably used here.

According to a further preferred embodiment of the invention, the roughening apparatus ensures a roughness which is in a range of ±20 μm, preferably ±10 μm.

The present invention also relates to paper packaging which is produced by the method according to the invention. The paper packaging is particularly preferably food packaging. Since the paper packaging can be produced so as to be free of plastics material and also free of other foreign matter, the paper packaging can be completely recycled.

BRIEF DESCRIPTION OF THE DRAWINGS

Preferred embodiments of the invention are described in detail below with reference to the accompanying drawings, in which.

DETAILED DESCRIPTION

An apparatus 1 and a method for joining paper material according to a first embodiment of the invention are described in detail below with reference to FIGS. 1 to 5.

Figure 1:
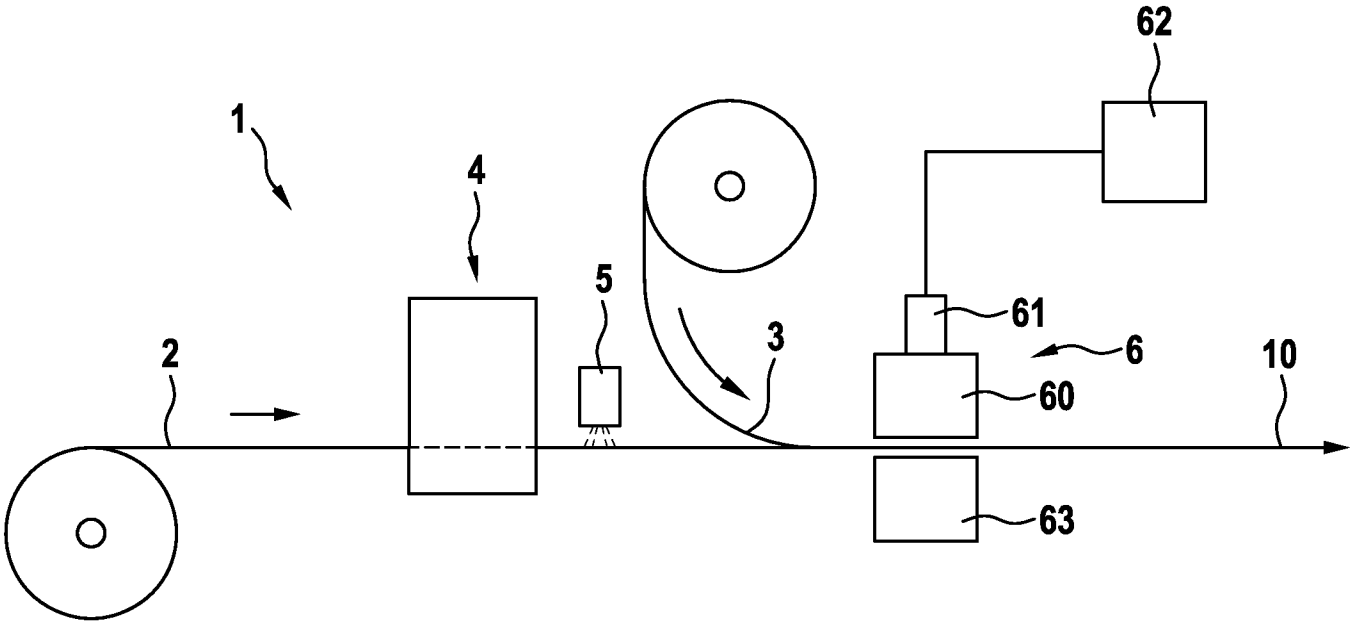
FIG. 1 is a schematic representation of a joining apparatus according to a first embodiment of the invention.

FIG. 1 schematically shows the structure of the apparatus 1 for joining paper material. As can be seen from FIG. 1, the apparatus 1 comprises a roughening apparatus 4, a moistening apparatus 5 and an ultrasonic friction welding apparatus 6.

In this embodiment, a first paper material 2 and a second paper material 3 are intended to be joined together at a joining region, in particular an edge region of the paper materials. The paper materials can, for example, be removed from a roller as continuous goods. The paper materials are free of plastics material and adhesive and have no coating at all.

A first joining region 20 is provided on the first paper material 2. A second joining region 30 is provided on the second paper material 3. This is shown schematically in the representation of the method according to the invention in accordance with the first embodiment in FIG. 5.

In the first embodiment, only the first joining region 20 is treated with a plurality of method steps, whereas the second joining region 30 remains without treatment. I.e., the second joining region 30 corresponds to the surface of the planar paper material.

Figure 5:
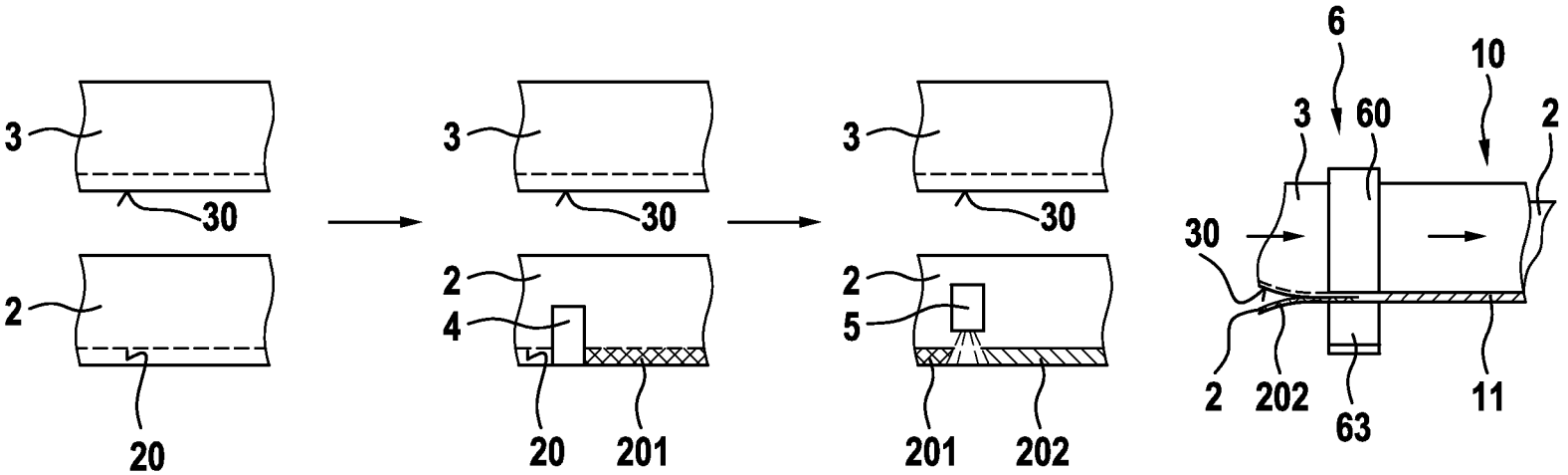
FIG. 5 is a schematic representation of the joining method according to the first embodiment.

As can be seen from FIGS. 1 and 5, the first paper material 2 is removed from the roller and fed to the roughening apparatus 4. Here, the first joining region 20 is roughened.

Figure 2:
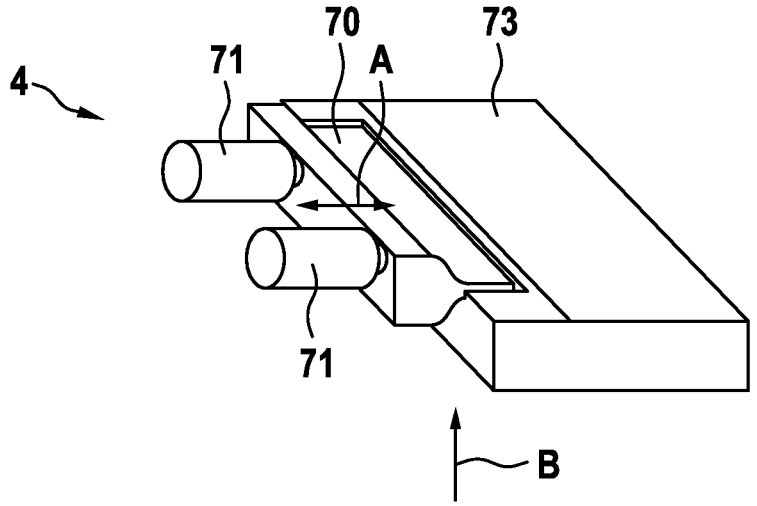
FIG. 2 is a schematic representation of a roughening apparatus of the first embodiment.

In this embodiment, the roughening apparatus 4 is an ultrasonic roughening apparatus, which is shown in detail in FIG. 2. The roughening apparatus 4 comprises a planar sonotrode 70, which is made to vibrate by means of a double converter 71. Furthermore, the roughening apparatus 4 comprises a planar anvil 73. The planar sonotrode 70 has a horizontal vibration direction A. The anvil 63 provides a joining force in a joining force direction B which is perpendicular to the sonotrode vibration A. For the sake of clarity, the first paper material 2, which is roughened at the first joining region 20, is not shown in FIG. 2.

Figure 3:
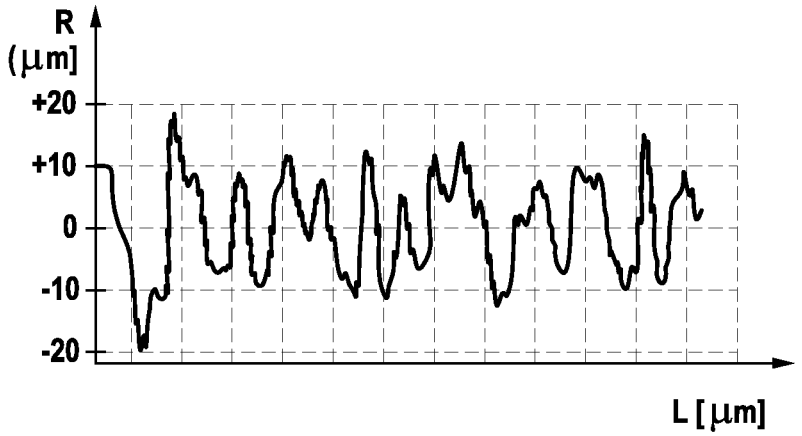
FIG. 3 shows a diagram which schematically shows the roughness of the roughened joining region of the first embodiment.

FIG. 3 shows a diagram which shows the roughness of the first joining region 20 after the roughening process. It is clear hereby that the ultrasonic roughening produces roughening having a height profile of approximately 20 μm, which has point elevations and depressions between +10 μm and −10 μm. The diagram shows the roughness R over the run length L of the first paper material 2.

When roughening by means of the roughening apparatus 4, the roughness of the surface of the first joining region 20 can be selectively influenced by means of the vibration duration and the vibration amplitude. The longer the vibration period, the more the surface of the first joining region 20 is changed and roughened. If the amplitude of the vibration of the sonotrode is reduced, the peel strength of the joined connection goes.

A contact surface of the sonotrode 70 with the first paper material 2 is preferably somewhat roughened, for example by means of glass bead blasting, such that better results are obtained during the roughening process.

Figure 4:
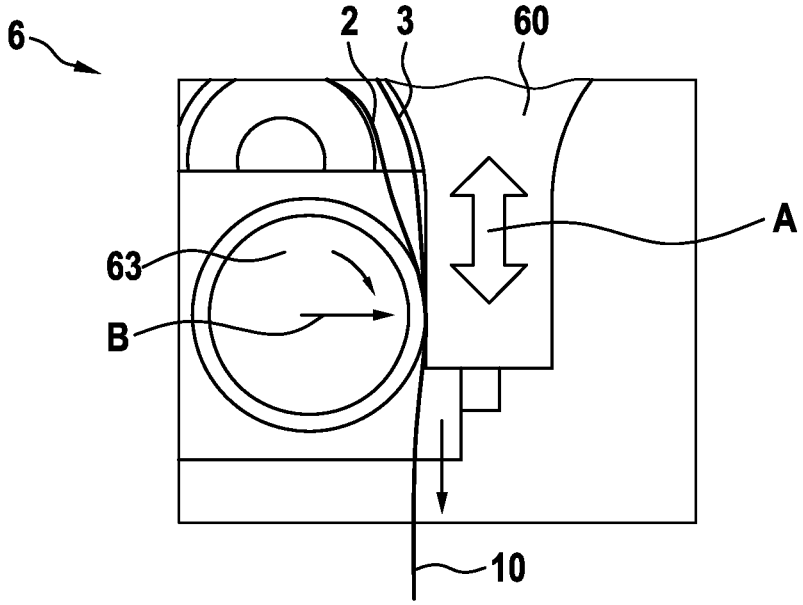
FIG. 4 is a schematic view of an ultrasonic welding apparatus according to the first embodiment.

FIG. 4 shows the ultrasonic friction welded connection 6, wherein an anvil 63 being provided in the form of a roll. A vibration direction A of the sonotrode 70 is perpendicular to a joining force direction B of the roll-shaped anvil 63. This can generate a lot of heat so that the joining process can be carried out by means of ultrasonic friction welding. It should be noted that the apparatus shown in FIG. 4 can also be used as a variant of a roughening apparatus.

As can also be seen from FIGS. 1 and 5, the first joining region 20 is moistened by means of the moistening device 5 before the actual joining process. Water is preferably used as the medium for moistening. Since the first joining region 20 was roughened by the roughening apparatus 4 before the moistening process, a three-dimensional increase of the joining surface results, which, in the presence of water due to the moistening, allows an improved hydrogen bridge bond to be formed during the joining process compared with a non-roughened surface.

In particular, no additives or plastics material coatings of the paper materials 2, 3 or the like are possible due to the roughening process. Untreated paper materials can be used for the joining process. As a result, the method according to the invention can be used universally.

FIG. 5 shows again schematically the method sequence of the process of joining the first and second paper material 2, 3. In the first step, the first joining region 20 is roughened by the roughening apparatus 4 such that a roughened first joining region 201 is created. The second joining region 30 remains untreated.

In the next step, the roughened first joining region 201 is moistened by means of the moistening apparatus 5. This creates a roughened, moistened first joining region 202. The second joining region 30 remains untreated.

The two paper materials 2, 3 are then fed to the ultrasonic friction welding apparatus 6, and the connection 11 between the first and second paper material is produced by ultrasonic friction welding. The roughening and moistening of the first joining region 20 can provide an excellent connection of paper materials. The second joining region 30 did not have to be processed in any way. As a result, this method according to the invention can be carried out particularly inexpensively.

Figure 6:
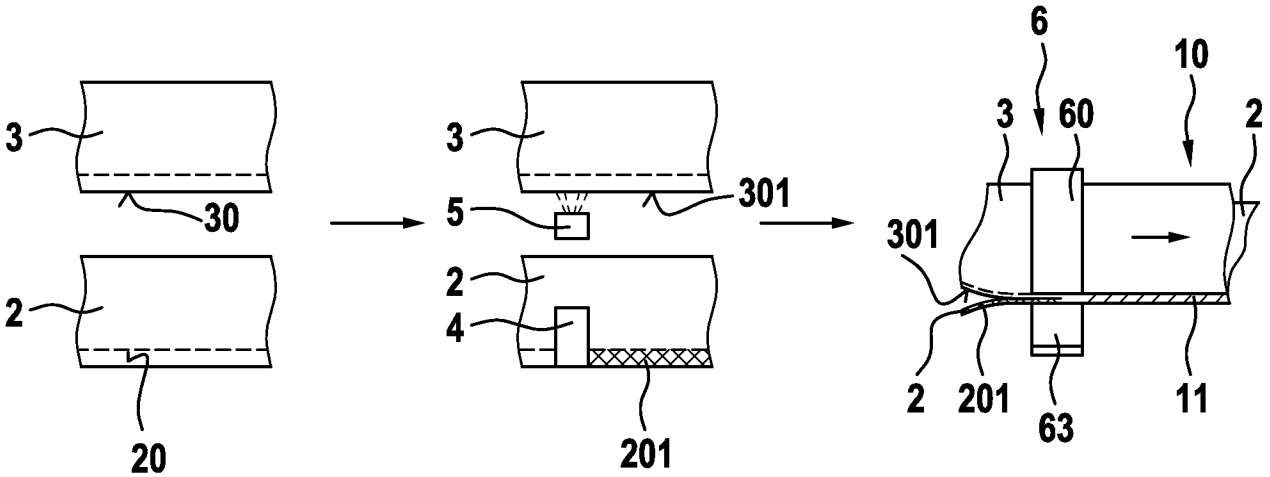
FIG. 6 is a schematic representation of a joining method according to a second embodiment.

FIG. 6 schematically shows a method for joining paper materials according to a second embodiment of the invention. Identical or functionally identical parts are denoted by the same reference signs. In contrast to the first embodiment, in the second embodiment the second joining region 30 is also processed. As can be seen from FIG. 6, the first joining region 20 is roughened in a first step by means of the roughening apparatus 4. At the same time, the second joining region 30 is moistened by means of a moistening apparatus 5. The first and second paper material 2, 3 are then fed to the ultrasonic friction welding apparatus 6 and joined together. With this design, the first joining region 20 and the second joining region 30 can be treated in parallel, and therefore a particularly compact joining apparatus 1 is possible.

Figure 7:
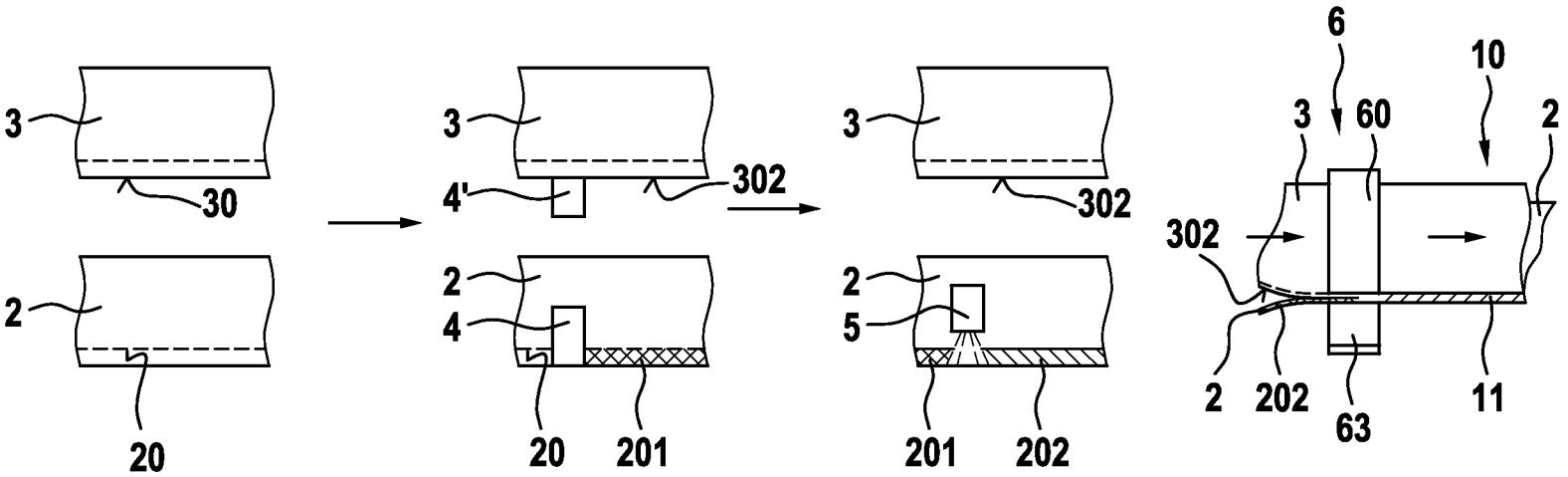
FIG. 7 is a schematic representation of a joining method according to a third embodiment.

FIG. 7 shows a method according to a third embodiment of the invention. The method for the first joining region 20 of the first paper material 2 according to the third embodiment corresponds to the first embodiment, such that in a first step the first joining region 20 is first roughened and then moistened. In contrast to the first embodiment, however, in the third embodiment the second joining region 30 is also treated. As can be seen from FIG. 7, the second joining region 30 is roughened by means of a second roughening apparatus 4', such that a roughened, second joining region 302 is produced. In the last step, the roughened second joining region 302 and the roughened and moistened first joining region 202 are interconnected in the ultrasonic friction welding apparatus 6.

Figure 8:
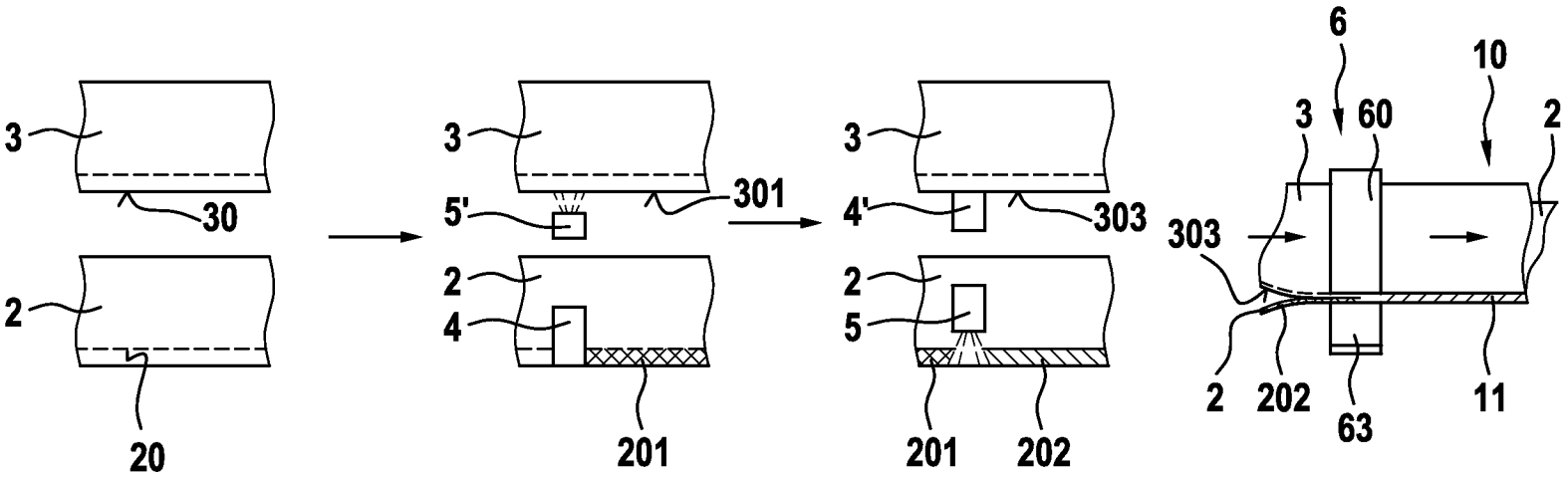
FIG. 8 is a schematic representation of a joining method according to a fourth embodiment.

FIG. 8 shows a method according to a fourth embodiment, in which the first joining region 20 is processed by roughening and moistening as in the first embodiment, and the second joining region 30 is first moistened by means of a second moistening apparatus 5' and then roughened using a second roughening apparatus 4'. The sequence of roughening and moistening in the first and second joining region 20, 30 is thus reversed. In the last step, the two joining regions of the first and second paper material 2, 3 are then joined again by means of the ultrasonic friction welding apparatus 6 to form a joined paper material 10. It should be noted here that the sequence of roughening and moistening, as shown schematically in FIG. 8, can also be reversed.

Figure 9:
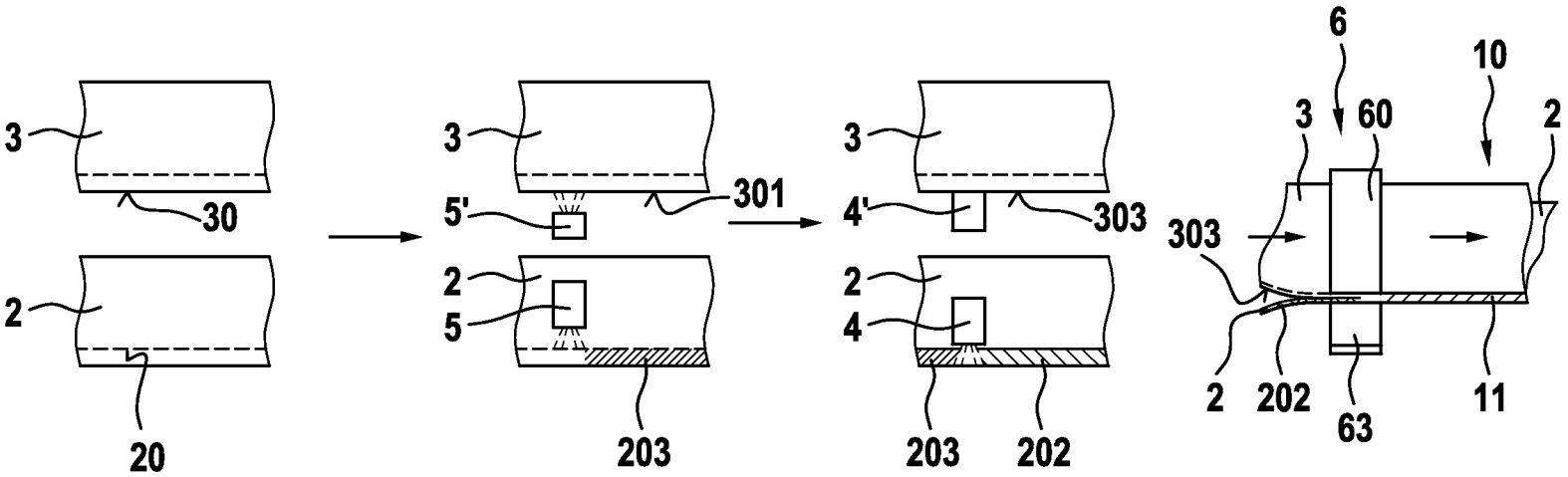
FIG. 9 is a schematic representation of a joining method according to a fifth embodiment.

FIG. 9 shows a method according to a fifth embodiment of the invention. In the fifth embodiment, both the first joining region 20 and the second joining region 30 are processed. As can be seen from FIG. 9, the first joining region 20 and the second joining region 30 are both moistened in a first step by means of moistening apparatuses 5, 5' and then roughened in a second step by means of roughening apparatuses 4, 4'. In the last step, the joining process is carried out again by means of the ultrasonic friction welding apparatus 6. The first joining region 20 is thus first moistened so as to form a moistened first joining region 203, which is then roughened so as to form a moistened and roughened first joining region 202. In the same way, the second joining region 30 is first moistened so as to form a moistened second joining region 301 and then roughened so as to form a moistened and roughened second joining region 303. The two joining regions are then joined again to form a joined paper material 10.

Figure 10:
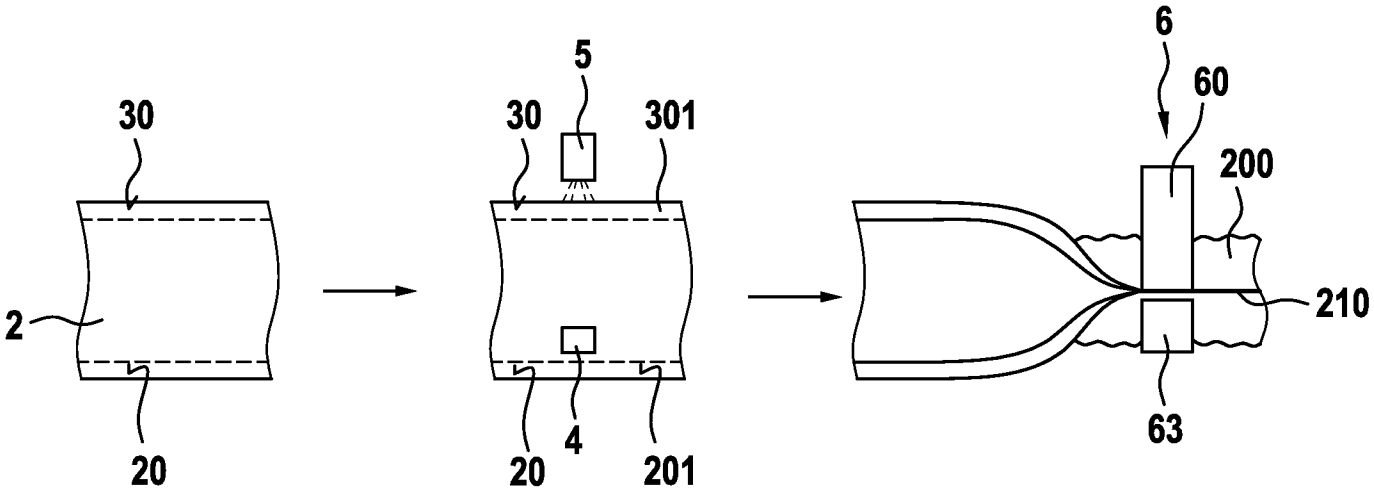
FIG. 10 is a schematic representation of a joining method according to a sixth embodiment.

FIG. 10 shows a method according to a sixth embodiment of the invention. Here, the first and second joining region 20, 30 are provided on a single paper material 2 and are joined to form a tubular bag 200 having a longitudinal seam 210. The first joining region 20 is roughened and the second joining region 30 is moistened.

For the production of a tubular bag, it should be noted that the variants described in FIGS. 6 to 9 can also only be implemented for a single paper material having a first and second joining region 20, 30.

It should also be noted that, according to the invention, different variants of the invention can be carried out as long as at least one moistening step and one roughening step are carried out on one or both joining regions 20, 30 of the paper materials 2, 3.

What is claimed is:

1. A method for joining paper material (2, 3) at a first joining region (20) and a second joining region (30), comprising the steps of:

roughening the first joining region (20), moistening the first joining region (20) after the roughening step, and joining the first and second joining region (20, 30) between a sonotrode (60) and an anvil (63) of an ultrasonic friction welding apparatus (6) by ultrasonic friction welding, wherein a vibration direction (A) of the sonotrode (60) is not parallel to a joining force direction (B) of a joining force of the anvil (63).

2. The method according to claim 1, wherein the vibration direction (A) is perpendicular to the joining force direction (B).

3. The method according to claim 1, wherein the method is carried out continuously such that a linear joined connection (11) is produced on the paper material.

4. The method according to claim 1, wherein the roughening of the first joining region is carried out in such a way that a roughness in a range of 20 μm between point elevations and depressions and having a uniform profile is achieved.

5. The method according to claim 1, wherein the roughening of the first joining region and the moistening of the first joining region occur along a same width of the first joining region.

6. The method according to claim 1, wherein the joining of the first and the second joining regions is carried out completely without additives.

7. The method according to claim 1, wherein the paper material to be joined is free of plastics material and adhesive.

8. The method according to claim 1, wherein the step of roughening is carried out by means of ultrasonic vibration.

9. A paper packaging having a connection produced by a method according to claim 1, wherein, during roughening of individual paper fibers of the first and the second joining regions, the individual paper fibers are released from a paper composite of the paper packaging and brought to a surface of the joining region.

10. The method according to claim 1, wherein the roughening of the first joining region is carried out in such a way that a roughness in a range of 10 μm between point elevations and depressions is achieved.

11. An apparatus for joining paper material (2, 3) at a joining region (20, 30) of the paper material, comprising a roughening apparatus (4) for roughening the joining region (20,30) of the paper material, a moistening apparatus (5) for moistening the joining region (20, 30) the moistening apparatus (5) configured to moisten the joining region (20, 30) after the roughening apparatus (4) roughens the joining region (20, 30), and an ultrasonic friction welding apparatus (6) comprising a sonotrode (60) for generating an ultrasonic vibration and an anvil (63) for generating a joining force, wherein the ultrasonic vibration is directed in a first direction (A) which is not parallel to a force direction (B) of the joining force of the anvil.

12. The apparatus according to claim 11, wherein the anvil is in the form of a roller or roll.

13. The apparatus according to claim 11, wherein the roughening apparatus (4) works by means of ultrasonic vibration.

14. The apparatus according to claim 11, wherein the roughening apparatus (4) produces a roughness in a range of 20 μm.

15. The apparatus according to claim 13, wherein a sonotrode (60) of the roughening apparatus (4) is designed to be flat and has a roughened surface.

16. The method according to claim 6, wherein the joining of the first and the second joining regions is carried out completely without additive plastics materials or adhesives.

17. The apparatus according to claim 11, wherein the roughening apparatus (4) produces a roughness in a range of 10 μm.

* * * * *